US005435013A

United States Patent [19]

Davis

[11] Patent Number: 5,435,013

[45] Date of Patent: Jul. 25, 1995

[54] GRIPPING GLOVE

[76] Inventor: Patricia J. F. Davis, 1341 Red Pine Trail, Wellington, Fla. 33414

[21] Appl. No.: 134,831

[22] Filed: Oct. 12, 1993

[51] Int. Cl.[6] ..... A41D 19/00

[52] U.S. Cl. ..... 2/161.1; 2/161.2; 2/163

[58] Field of Search ..... 2/161.2, 161.4, 163, 2/162, 16, 17, 19, 159, 160, 161.1, 161.2, 161.4, 161.6

[56] References Cited

U.S. PATENT DOCUMENTS

| | | | |
|---|---|---|---|
| 883,761 | 4/1903 | Taylor | 2/161.8 |
| 2,496,808 | 2/1950 | Moore | 2/161.2 |
| 2,751,598 | 6/1956 | Romeo | 2/161.3 |
| 2,852,779 | 9/1958 | Roessler . | |
| 3,348,238 | 10/1967 | Hydock . | |
| 3,408,657 | 11/1968 | Gallagher | 2/159 |
| 4,730,354 | 3/1988 | Saito | 2/161.2 |
| 4,796,306 | 1/1989 | Mitchell . | |
| 5,004,231 | 4/1991 | Alread . | |
| 5,022,094 | 6/1991 | Hames et al. . | |
| 5,033,120 | 7/1991 | Myers . | |
| 5,224,220 | 7/1993 | Andriola | 2/163 |

*Primary Examiner*—Andrew M. Falik
*Assistant Examiner*—Amy B. Vanatta
*Attorney, Agent, or Firm*—Dowell & Dowell

[57] ABSTRACT

A gripping glove is disclosed for enhancing the ability of an individual to grasp an object such as a shaft or handle of a bat, pole, racket or club. The griping glove includes a body portion having a back side, a front or palm side and finger elements having elongated extensions. Fastening material is provided to retain the finger extensions in a substantially fixed arrangement relative to the front side of the body portion. A strap is attached to the body portion and overlays the finger extensions after they have been secured so as to prevent detachment of the extensions from the front side of the glove.

13 Claims, 3 Drawing Sheets

17
15
13
14
11
18
18
21
25
27
10
19

GRIPPING GLOVE

BACKGROUND OF THE INVENTION

This invention relates to a glove, and, more particularly, to an adjustable gripping glove which enhances the ability of a user having an impaired grip to grasp an object.

Many individuals suffer from impaired hand grips which limit their ability to grasp objects and to maintain a grip about such objects for extended periods of time without significant discomfort or pain. Impaired hand grips may be the result of hand injuries caused by common overuse of the hand or accidents, nerve damage, sickness, or arthritis commonly associated with advanced age. Impaired grips are characterized by limited flexibility, strength and endurance.

Such individuals suffering from impaired hand grips are unable to fully participate in strenuous activities such as golf, tennis, racketball, baseball and other sports, or even in relatively non-strenuous activities such as fishing because they are unable to adequately grasp handles of golf clubs, tennis rackets, bats or fishing rods, especially for extended periods of time. This is an unfortunate reality because although such individuals have impaired hand grips, they may otherwise be physically able to perform these activities. Thus it is oftentimes the problem of impaired hand grips alone which prevents individuals from enjoying these activities.

Accordingly, there has been a need for a hand grip enhancing device which improves the ability of individuals having impaired hand grips to grasp objects and to maintain their grip for extended periods of time. Such a device would enable inflicted individuals to continue to enjoy sports such as golf, tennis and fishing, despite their reduced physical capabilities.

SUMMARY OF THE INVENTION

The present invention has been made in view of the above-described inadequacies of the related art and has as an object to provide a gripping device in the form of a glove which enhances an individual's ability to grasp an object.

Additional objects and advantages of the present invention will become apparent from the detailed description which follows, considered in conjunction with the accompanying drawing figures.

To achieve the objects of the invention, as embodied and broadly described herein, the gripping glove of the present invention comprises a body portion including a back side, a front or palm side and finger elements with elongated extensions. Fastening material is provided to retain the finger extensions in a substantially fixed arrangement relative to the front side of the glove. A strap is attached to the body portion and is movable to an overlaying relationship with respect to the finger extensions so as to prevent detachment of the extensions from the front side of the glove after they have been secured thereto.

DETAILED DESCRIPTION OF THE PREFERRED EMBODIMENTS

Figure 1:
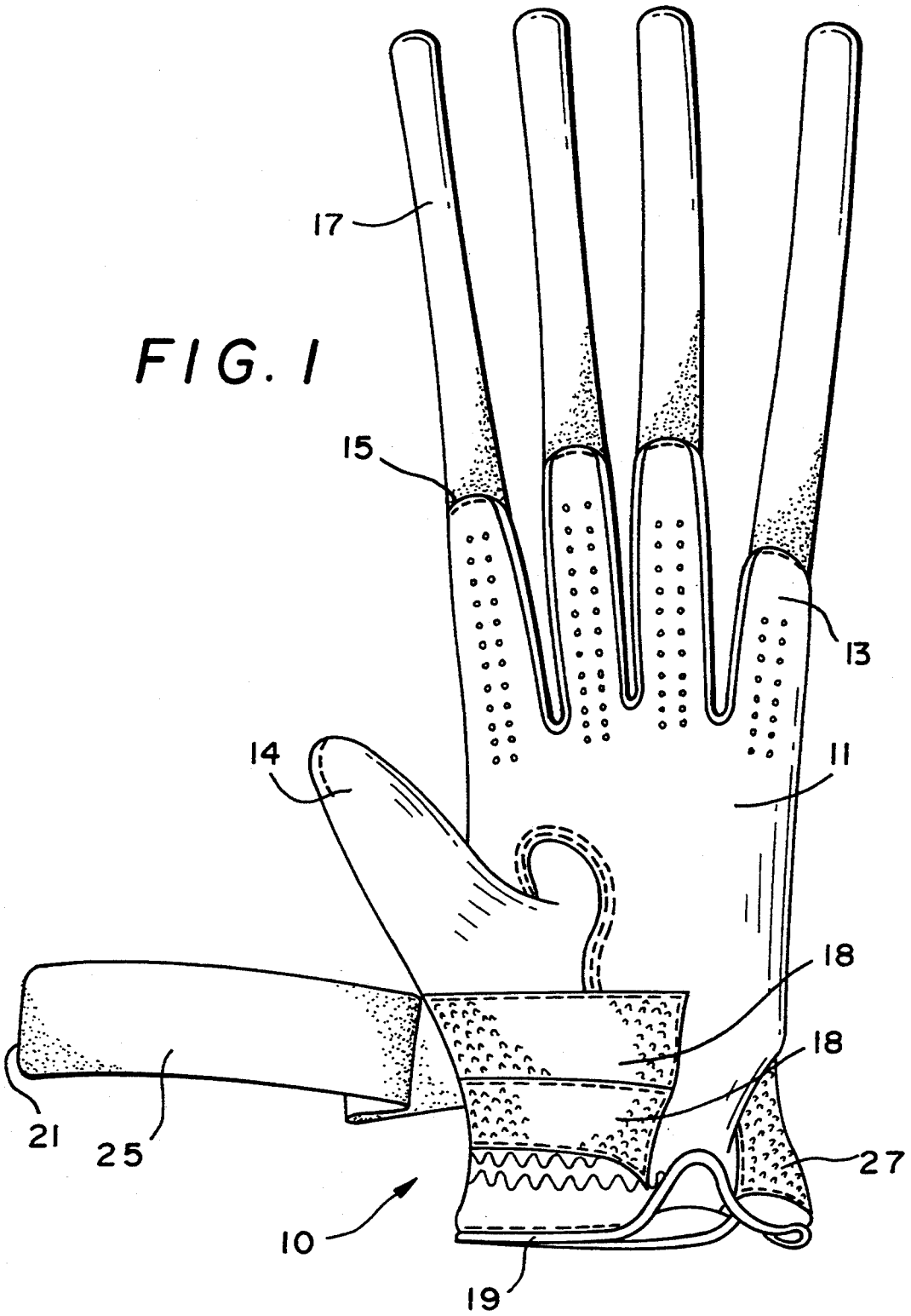
FIG. 1 is a front plan view of a gripping glove in accordance with a preferred embodiment of the invention.
Figure 2:
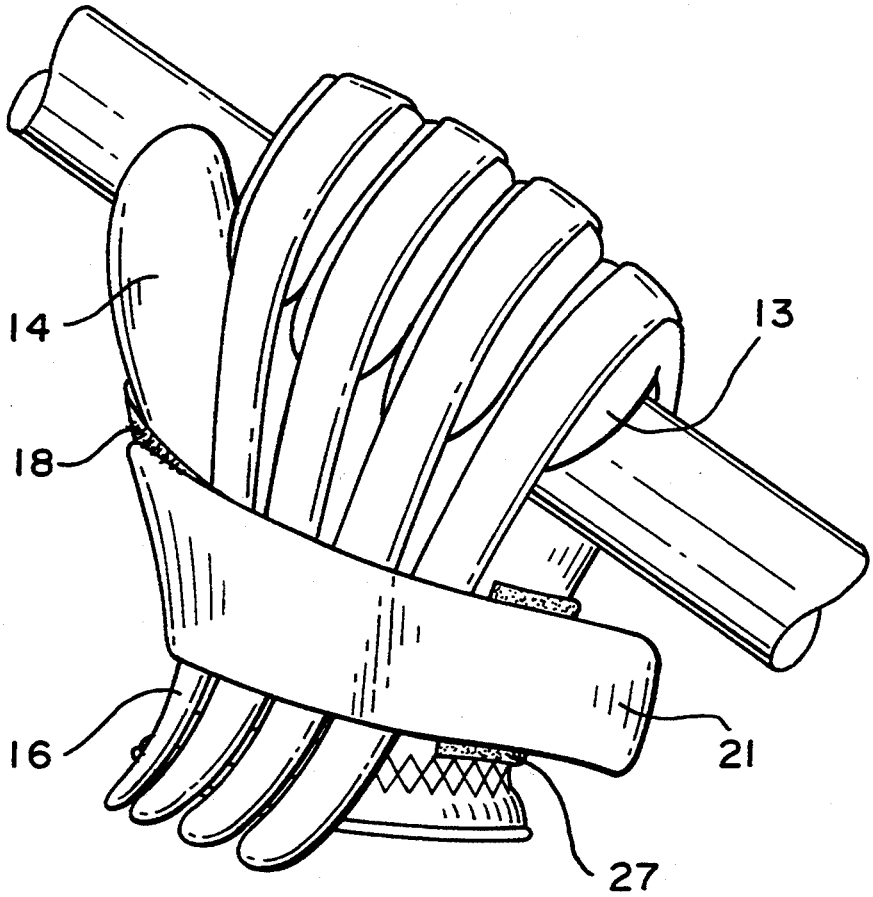
FIG. 2 is an illustrational view showing the manner of use of the gripping glove of FIG. 1.
Figure 3:
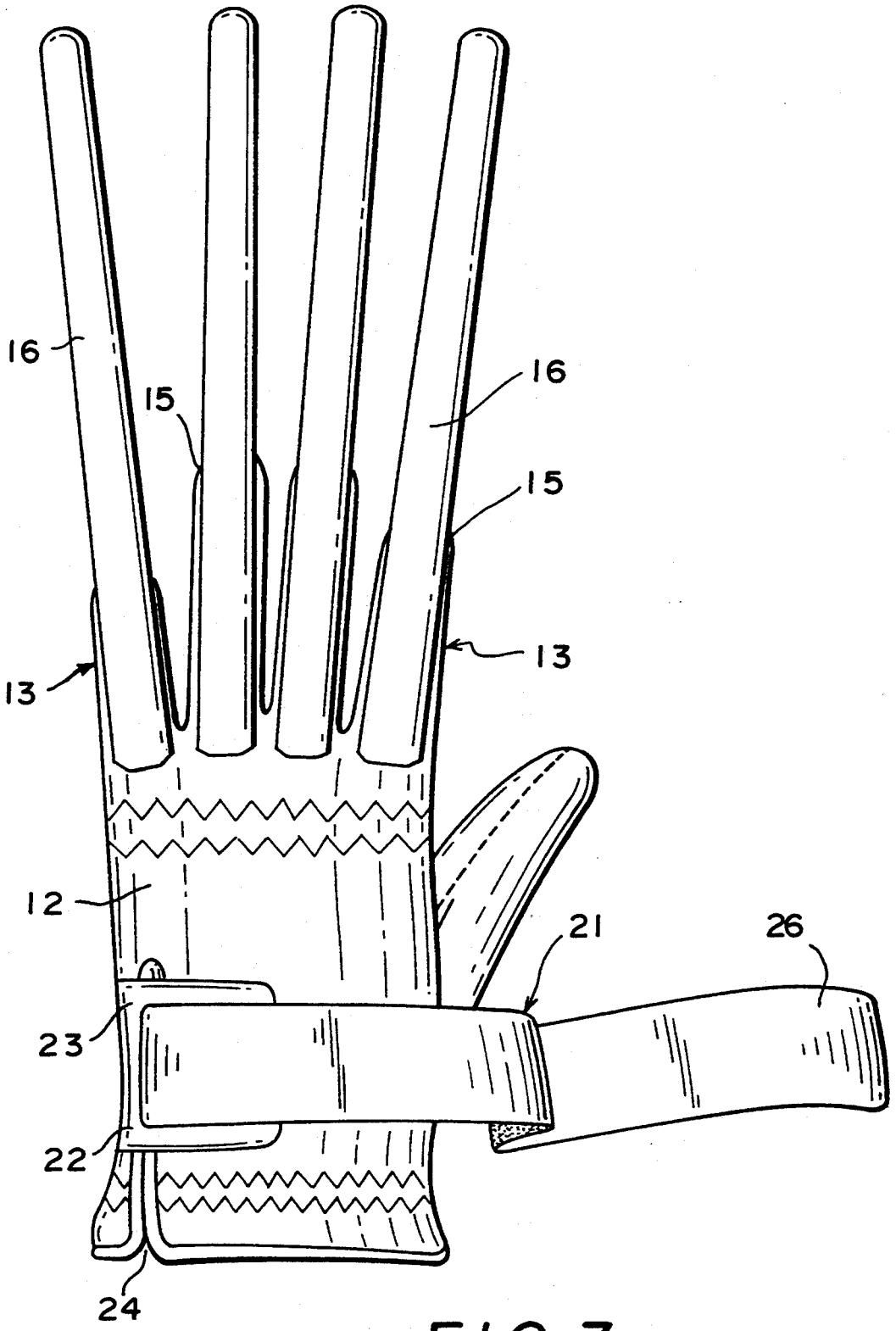
FIG. 3 is a back plan view of the gripping glove of FIG. 1.

With reference to the drawing figures, FIGS. 1–3 illustrate a gripping glove 10 in accordance with a preferred embodiment of the invention.

The gripping glove 10 comprises a body portion including a front or palm side 11, a back side 12, finger elements 13, and a thumb element 14. The finger elements preferably each have closed ends 15. One or more of the finger elements may optionally have open ends through which an individual's fingers may extend.

In accordance with the invention, the gripping glove includes first fastening members for adjustably retaining the finger elements 13 in a substantially fixed relationship relative to the front side 11 of the body portion. As embodied herein, the first fastening members preferably include a hook and loop type fastening material such as VELCRO TM associated with both the finger elements and the front side 11 of the gripping glove.

As illustrated in FIG. 3, the finger elements 13 include elongated extension strips 16 which extend beyond the closed ends thereof. A hook or loop fastening element 17 is provided on the front sides of each of the finger extensions 16. The extension strips and associated fastening elements may be attached to a selected number of the finger elements and are preferably attached to the finger elements by stitching.

A mating hook or loop fastening element 18 is fixedly attached to the front side 11 of the glove body along the area of the base of the thumb to the open end 19 of the glove and contiguous portion of the palm of the glove, and extends therefrom along the edges of the glove to the area of the back side of the base of the thumb. The fastening element 18 is provided to adjustably engage the fastening elements 17 associated with the finger portions 13 as illustrated in FIG. 2. The position of the fastening element 18 permits the finger extensions to be directed rearwardly of the glove in a natural alignment with the finger elements after an individual has established a proper grip of a club or racket handle or shaft.

In accordance with the preferred embodiment of the invention, a strap 21 is provided to overlay the finger extensions 16 of the finger elements 13 when they are attached to the fastening element 18 so as to prevent the extended portions from becoming detached therefrom. The strap is fixedly attached at one end to a conventional adjustable flap 22 used to adjust the fit of the glove.

The adjustable flap 22 is in turn attached at end 23 to the back side 12 of the glove adjacent to an elongated slit 24. The flap has a hook or loop fastening element on its inner face (not shown) which is adjustably engageable with a mating hook or loop fastening element (not shown) provided on the back side of the glove. The adjustable flap and expandable opening enable the gripping glove to be easily removed and comfortably fit an individual's hand.

A second fastening member is provided for retaining the strap 21 in an overlaying relationship relative to the finger extensions 16 to prevent their detachment from the fastening element 18. The second fastening member preferably includes a hook or loop fastening element 25 attached to a selected length of the inner face of the free end 26 of the strap and a mating hook or loop fastening element 27 secured to the body portion of the glove at a position along the edge of the glove and toward the back thereof, as illustrated in FIGS. 1 and 3.

The manner of use of the gripping glove of the present invention will now be described in greater detail with reference to FIG. 2. After the gripping glove 10 is fitted to an individual's hand by adjustably securing the flap 22, an object such as a golf club or tennis racket handle is grasped and the user's fingers are positioned in a comfortable and proper alignment about the handle. The finger extensions 16 of the finger elements 13 are then pulled and attached to the fastening element 18 on the front and side of the gripping glove in a slightly spaced manner. Next, to prevent detachment of the fastening elements 17 on the extensions 16 from the fastening element 18, the strap 21 is positioned to overlay the back sides of the extensions and then made taut and fastened to the mating fastening element 26. Although it might be possible for this first fastening member to become disengaged by force being applied along the extension portions, after the strap 21 is secured over the extension portions, the extension portions cannot be accidentally disengaged from the front or palm portion of the glove.

The gripping glove in accordance with the present invention provides an easily adjustable, yet highly secure, grip for all individuals. It is particularly advantageous for individuals having a hand grip which is of limited strength due to injury, sickness, or advanced age. The gripping glove allows these individuals to overcome this problem and comfortably form and maintain a firm and consistent grip. It also reduces hand fatigue because it enables the individual to relax his or her hand muscles and still maintain a constant grip about an object. It thus enables impaired individuals to continue to enjoy sports such as golf, tennis and fishing, despite their physical limitation.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A gripping glove, comprising:

a body portion including a back side, a front side and finger elements having ends spaced from said body portion;

at least one elongated extension, each said extension being permanently attached to one of said finger elements and extending outwardly from the end thereof;

a first fastening means for detachably retaining each said extension in a substantially fixed arrangement relative to said front side;

a strap attached to said body portion and extending generally transversely with respect to said finger elements; and a second fastening means for detachably retaining said strap in overlaying relationship relative to said at least one extension to prevent detachment of said at least one extension from said body portion of the glove.

2. The gripping glove of claim 1, wherein said first fastening means comprises a hook and loop fastening material having first and second interengageable mating elements.

3. The gripping glove of claim 2, wherein a first mating element is attached to each said elongated extension and said second mating element is attached to said body portion.

4. The gripping glove of claim 3, comprising an elongated extension fixedly attached to each of said finger elements and a first mating element is attached to each said extension.

5. The gripping glove of claim 3, wherein said strap is fixedly attached at a first end to said body portion.

6. The gripping glove of claim 3, wherein said second fastening means comprises a hook and loop fastening material having third and fourth interengageable mating elements.

7. The gripping glove of claim 6, wherein said third mating element is attached to said strap and said fourth mating element is attached to said body portion.

8. The gripping glove of claim 1, wherein each said elongated extension is substantially parallel to a finger element.

9. The gripping glove of claim 4, wherein each of said elongated extensions are substantially parallel to one of said finger elements.

10. A gripping glove, comprising:

a body portion including a back side, a front side and finger elements having ends spaced from said body portion;

a plurality of elongated extension strips, each of said extension strips being permanently secured to one of said finger elements and extending outwardly from the end thereof;

a first fastening element attached to each of said extension strips and a second fastening element attached to said body portion for detachably engaging said first fastening element to detachably retain said extension strips in a substantially fixed arrangement relative to said front side of said body portion;

a strap attached to said body portion; and a third fastening element attached to said strap and a fourth fastening element attached to said body portion for detachably engaging said third fastening element to detachably retain said strap in overlaying relationship relative to said extension strips to prevent detachment of said extension strips from said front side of said body portion.

11. The gripping glove of claim 10, wherein said body portion of said glove includes an area which is disposed adjacent an individual's palm at the base of the thumb and said second fastening element is positioned along said area.

12. The gripping glove of claim 11, wherein said fourth fastening element is located at an edge of said body portion between said front and back sides.

13. The gripping glove of claim 10, wherein said elongated extension strips are substantially parallel to said finger elements.

* * * * *